United States Patent [19]

Oquita

[11] 4,015,364

[45] Apr. 5, 1977

[54] PINATA HAVING WEAKENED BOTTOM WALL AND MEANS FOR BREAKING SAME

[76] Inventor: Ramiro Oquita, 6014 Chandler Drive, San Diego, Calif. 92117

[22] Filed: Sept. 29, 1975

[21] Appl. No.: 617,602

[52] U.S. Cl. ..... 46/11; 229/7 R

[51] Int. Cl.² ..... A63H 33/00

[58] Field of Search ..... 46/11, 38; 229/7 R, 229/8

[56] References Cited

UNITED STATES PATENTS

| | | | |
|---|---|---|---|
| 247,302 | 9/1881 | Candy | 46/11 |
| 1,301,118 | 4/1919 | Gartner | 46/38 X |
| 1,732,282 | 10/1929 | Sage | 229/7 R X |
| 1,747,805 | 2/1930 | Van der Linde | 229/7 R X |
| 2,760,714 | 8/1956 | Rasmussen | 229/7 R X |
| 3,027,286 | 3/1962 | Kurhan | 229/8 UX |
| 3,702,675 | 11/1972 | Bajo | 229/7 R |

*Primary Examiner*—F. Barry Shay

*Attorney, Agent, or Firm*—Nilsson, Robbins, Dalgarn & Berliner

[57] ABSTRACT

A pinata for enclosing a plurality of small items carried on a bottom wall in which the bottom wall is formed with a line of weakness for enabling it to break-away upon application thereto of a moderate force such as obtained by shaking so that the items bounce on the bottom wall or by a child grabbing a pull line attached to the bottom wall.

8 Claims, 5 Drawing Figures

FIG. 1.
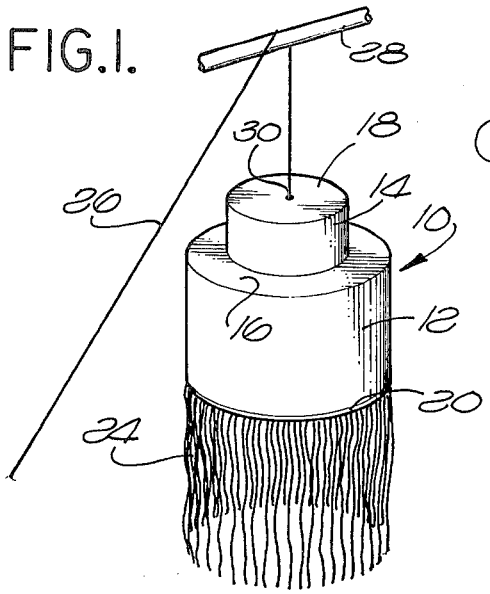
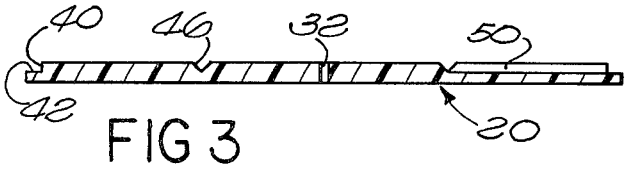
FIG 3
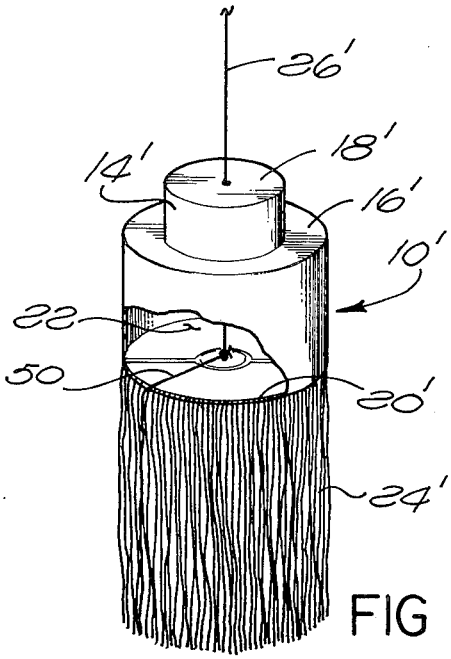
FIG 4
FIG 2
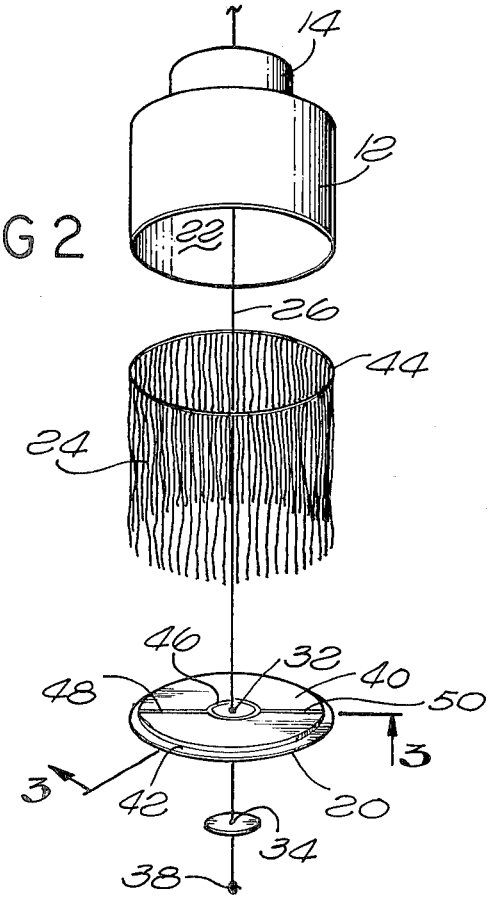
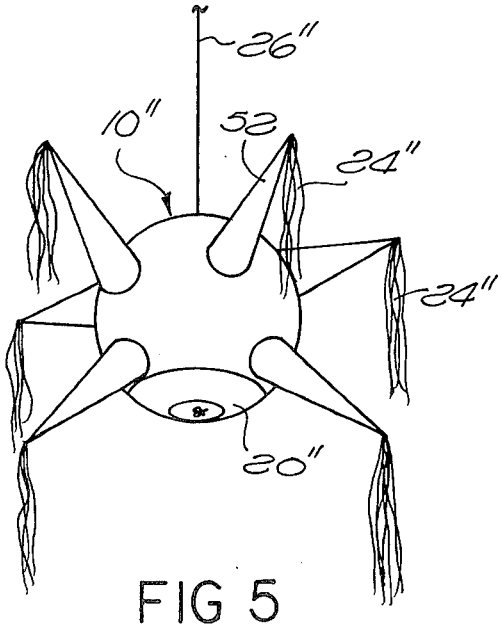
FIG 5

PINATA HAVING WEAKENED BOTTOM WALL AND MEANS FOR BREAKING SAME

FIELD OF THE INVENTION

The field of art to which the invention pertains includes the field of containers, specifically pinatas.

BACKGROUND AND SUMMARY OF THE INVENTION

Pinata breaking celebrations are quite popular in Mexico and in the Mexican communities of the southwestern United States. Pinatas are traditionally a pot or container ornamented with colorful paper and filled with candy, nuts, confetti and/or token gifts such as small toys and the like. The pinata is suspended above a party area and at the appropriate time, and with celebration, it is broken so that the treats are scattered among the guests who in turn can keep whatever they collect. The usual method of breaking the pinata is by beating it with a club or cane and this is either done by a blindfolded child who is the subject of the celebration or by several chidren in succession, each given a certain number of turns in which to break the pinata. Unfortunately, as a result of the enthusiasm of the guests in gathering close to the pinata so as to obtain a larger number of candies or gifts, it occasionally happens that a child is hit by the club or cane. Additionally, the traditional pinata is made of clay pottery and large falling fragments can cause injury to a young child. Modern pinatas are often made of papier mache, avoiding the dangers of cracked clay fragments, but such pinatas are generally more difficult to break requiring greater swings with the resultant danger from that aspect to the children.

The present invention provides a pinata which avoids the foregoing dangers. The pinata includes a bottom wall having an extended surface and side and top walls which cooperate with the bottom wall to define a substantially enclosed chamber whereby a plurality of small items such as candy, toys and the like may be carried in the chamber on the bottom wall. At least one line of weakness is formed through the extended surface of the bottom wall to enable at least a substantial portion of the bottom wall to break-away upon application thereto of a moderate force, a force which in the absence of the line of weakness would be insufficient to cause the bottom wall to break-away. Means are provided for suspending the pinata which, in one embodiment, comprises a suspension line through openings therefor in the top and bottom walls of the pinata and a retention member, larger than the bottom wall opening, secured to the suspension line exteriorly of the bottom wall. The suspension line and retention member hold the bottom wall in assembled relation with, but free of direct attachment to, said side and top walls, i.e., permitting the bottom wall to fall away when it breaks away. Upon successive pulls or jerks on the line, the candy and other treats in the pinata bounce down against the bottom wall until the bottom wall breaks along the line of weakness and spills the treats. In another embodiment, a pull line is connected to, and dependant from, the bottom wall whereby pulling of the line enables the bottom wall to directly break-away. With this embodiment, a plurality of decoy lines of like construction can be provided extending a like distance from the bottom wall whereby to disguise the identity of the pull line.

With respect to the first embodiment, the guest can be blindfolded and seek to find the suspension line to jerk the same and break-away the bottom wall. In the second embodiment, the guests can try to guess which of the many lines are decoy lines and which is the true pull line. In either case, a safe yet enjoyable and stimulating pinata is provided. It will also be appreciated that the only component which is broken from the pinata is the bottom wall. Therefore, one can utilize the pinata on many occasions with replacement required only for the bottom wall.

BRIEF DESCRIPTION OF THE DRAWINGS

FIG. 1 is a perspective view showing one form of pinata in accordance with the present invention;

FIG. 2 is a perspective, exploded view of the pinata of FIG. 1;

FIG. 3 is a cross sectional view of the bottom wall of FIG. 1 taken on line 3—3 of FIG. 1;

FIG. 4 is a perspective, partially cut-away view of a pinata which is similar in its external appearance to the pinata of FIG. 1 but which operates in accordance with a second embodiment; and FIG. 5 is a perspective view of a pinata constructed in accordance with the principles of the pinata of either FIGS. 1 or 4, but which has a different external appearance.

DETAILED DESCRIPTION

As required, detailed illustrative embodiments of the invention are disclosed herein. However, it is to be understood that these embodiments merely exemplify the invention which may take forms that are different from the specific illustrative embodiments disclosed. Therefore, specific structural and functional details are not to be interpreted as necessarily limiting, but as a basis for the claims which define the scope of the invention.

Referring to FIG. 1, a pinata 10 is disclosed having a layer of stacked generally cylindrical side walls 12 and 14 and concentric top walls 16 and 18 arranged in two tier form to simulate a birthday cake. The side walls can be in parallel cylindrical form or can have a draft of 3–5° for stacking during manufacture. A bottom wall 20 closes with the lowermost cylindrical side wall 12 so that a chamber (22 in FIG. 2) is obtained by cooperation of the bottom wall 20 and side and top walls 12, 14, 16 and 18. A plurality of decorative paper streamers 24 depend from the perimeter of the bottom wall 20. The pinata 10 is suspended by means of a line 26 looped over a supporting beam 28.

Referring additionally to FIG. 3, the suspension line 26 extends through a central opening 30 (FIG. 1) formed in the top wall 18 therefor and from there through a central opening 32 formed through the bottom wall 20. The end of the suspension line 26 is threaded through a close fitting opening 34 in a retention member 36 and secured by means of a simple knot 38.

The bottom wall 20 is in the form of a generally planar disc 40 with a flanged perimeter 42. A ring 44 of wire or the like is carried on the flanged portion 42 of the bottom wall 20 adjacent the disc 40 and fits snugly between the disc 40 and inner surface of the cylindrical side wall 12. The ring 44 carries the above-referred to plurality of decorative paper streamers 24. In place of paper streamers, one could of course use cloth streamers or one could use strings which can be variously colored as desired.

Referring to FIG. 3 in addition to FIG. 2, the bottom wall 20 is formed with an annular line of weakness 46 around the central opening 32 and additional lines of weakness 48 (FIG. 2) and 50 radiate from the annular line of weakness 46 to the outer perimeter of the bottom wall disc 40. The lines of weakness 46, 48 and 50 are sufficiently deep, and the bottom wall 20 is sufficiently rigid, so that a substantial portion of the bottom wall breaks-away upon application thereto of a force which in the absence of the lines of weakness would be insufficient to cause the break-away. In particular, the lines of weakness 46, 48 and 50 enable the bottom wall to break away upon shaking of the pinata so that the plurality of small treats contained therein, as a result of bouncing on the bottom wall, cause the bottom wall to break away, spilling the treats onto the party area. To facilitate break-away, the retention member 36 can be in the form of a rigid disc smaller in diameter than the diameter of the area defined by the annular line of weakness 46.

In play, the guest of honor is blindfolded and set to the task of finding the suspension line 26. Upon finding the line 26 he jerks it until the bottom wall 20 of the pinata breaks to release the treats inside the chamber 22. Subsequently, the pinata can be reused by simply replacing the bottom wall 20.

Referring now to FIG. 4, an alternative embodiment is illustrated in which the pinata 10' is similar in all respects to the pinata 10 of FIG. 1 including side walls 12' and 14' and top walls 16' and 18' cooperating with a bottom wall 20' to form a chamber 22' in which treats can be stored. A suspension line 26' extends through the top wall 18' and is centrally connected to the bottom wall 20' by any means which can include a retention member such as the retention member 36 illustrated in FIG. 2. In the present embodiment, there is provided a pull line 50 connected to and dependent form the bottom wall 20'. The pull line 50 can be connected directly to the bottom wall 20', or, as shown, can be connected to the suspension line 26, conveniently at a point immediately adjacent the bottom wall 20'. Upon pulling of the pull line 50, the bottom wall 20 is directly broken-away to spill the treats contained in the chamber 22'. As a further feature, the pull line 50 extends downwardly from the bottom wall 20' a distance which is the same as that of the streamers 24' and the streamers 24' are of like construction to the pull line 50 so as to serve as decoys therefor. In this regard, the pull line 50 and streamers 24' can be formed of cord or can be each cloth streamer, or even paper streamers if the paper is sufficiently strong to withstand the thrust necessary to break-away the bottom wall 20'.

In use of the second embodiment, the various guests at the party can take turns in guessing which of the streamers 24' leads to breaking of the pinata. Each guest would then pull on his chosen streamer until it breaks or until, if it is the pull line 50, the bottom wall 20' breaks away, spilling the treats.

Referring now to FIG. 5, there is illustrated an embodiment in which a pinata 10'' is provided employing the mechanism of operation of either of the pinata 10 of FIGS. 1–3 or of the pinata 10' of FIG. 4. The pinata 10'' of FIG. 5 is spherical in shape rather than cylindrical and is provided with a plurality of conical projections 52 and a plurality of streamers 24'' extend from the tips of each projection 52. In the event that the mechanism of FIG. 1 is used to cause break-away of the pinata 10'' of FIG. 5, the bottom wall 20'' is formed with lines of weaknesses on its interior surface, much in the way of the wall of FIG. 3. If the embodiment of FIG. 4 is utilized, one of the streamers 24'' extends to the suspension line 26'' internally of the pinata 10'' and is secured thereto so as to permit break-away of the bottom wall 20'' upon pulling thereof in the manner as described with respect to operation of the pinata 10' of FIG. 4.

The pinata in each of the foregoing embodiments is constructed of rigid, foamed polystyrene, but each unit could be made of other materials as previously indicated. Additionally, various changes can be made in the present invention without departing from the spirit of the invention as defined by the appended claims.

I claim:

1. A pinata, comprising:

a bottom wall having an extended surface;

side and top walls cooperating with said bottom wall to define a substantially enclosed chamber whereby a plurality of small items may be carried in said chamber on said bottom wall; and means for suspending said pinata and for holding said bottom wall in assembled relation with, but free of direct attachment to, said side and top walls, comprising a suspension line through openings therefor in the top and bottom walls of said pinata and a retention member larger than said bottom wall opening secured to said suspension line exteriorly of said bottom wall, whereby to enable said pinata bottom wall to break-away upon successive pulling of said suspension line when a large number of said items are carried in said pinata on said bottom wall;

said means including at least one line of weakness through said bottom wall extended surface enabling at least a substantial portion of said bottom wall to break-away upon application thereto of a force which in the absence of said line of weakness would be insufficient to cause said break-away.

2. The pinata of claim 1 wherein said line of weakness extends substantially across said bottom wall.

3. The pinata of claim 1 wherein said line of weakness is annularly formed on said bottom wall.

4. The pinata of claim 3 including additional lines of weakness extending from said annular line of weakness substantially to the outer bounds of said bottom wall.

5. The pinata of claim 1 wherein said line of weakness is annularly formed on said bottom wall surrounding a bottom wall surface region and said retention member is smaller than said surface region.

6. The pinata of claim 1 formed of rigid, foamed polystyrene.

7. A pinata, comprising:

a bottom wall having an extended surface;

side and top walls cooperating with said bottom wall to define a substantially enclosed chamber whereby a plurality of small items may be carried in said chamber on said bottom wall;

means for suspending said pinata and for holding said bottom wall in assembled relation with, but free of direct attachment to, said side and top walls, comprising a suspension line disposed through an opening in said top wall; and means including at least one line of weakness through said bottom wall extended surface enabling at least a substantial portion of said bottom wall to break-away upon application thereto of a force which in the absence of said line of weakness would be insufficient to cause said break-away, said enabling means including a pull line connected to, and dependent from, said bottom wall whereby pulling thereof enables said bottom wall to break-away, said pull line being connected to said suspension line interiorly of said pinata, extending across said bottom wall and depending from an edge of said bottom wall.

8. The pinata of claim 7 including a plurality of decoy lines of like construction to said pull line and extending a like distance from said bottom wall whereby to disguise the identity of said pull line.

* * * * *